US005192053A

United States Patent [19]

Sehlstedt

[11] Patent Number: 5,192,053

[45] Date of Patent: Mar. 9, 1993

[54] DEVICE FOR INITIATING A LIFTING MOVEMENT IN A LIFTING DEVICE

[76] Inventor: Per-Olof Sehlstedt, Berge, S-870 10 Alandsbro, Sweden

[21] Appl. No.: 681,539

[22] PCT Filed: Oct. 24, 1989

[86] PCT No.: PCT/SE89/00584

§ 371 Date: May 7, 1991

§ 102(e) Date: May 7, 1991

[87] PCT Pub. No.: WO90/04565

PCT Pub. Date: May 3, 1990

[30] Foreign Application Priority Data

Oct. 25, 1988 [SE] Sweden ..... 8803815

[51] Int. Cl.[5] ..... B66F 3/22

[52] U.S. Cl. ..... 254/122; 187/18; 182/63

[58] Field of Search ..... 254/122, 123, 124, 129, 254/131, 8 B, 8 C, 8 R, 9 R, 9 B, 9 C; 187/18, 8.72, 8.71; 182/63, 144, 148

[56] References Cited

U.S. PATENT DOCUMENTS

| | | | |
|---|---|---|---|
| 2,899,172 | 8/1959 | Cresci | 254/8 |
| 3,032,319 | 5/1962 | Dale | 254/122 |
| 3,330,381 | 7/1967 | Halstead | 187/8.72 |
| 3,991,857 | 11/1976 | Wolk et al. | 254/122 |
| 4,526,346 | 7/1985 | Galloway et al. | 254/122 |

*Primary Examiner*—Bruce M. Kisliuk
*Assistant Examiner*—Eileen P. Morgan
*Attorney, Agent, or Firm*—Nixon & Vanderhye

[57] ABSTRACT

The invention relates to a device for initiating a lifting movement in a lifting mechanism, for instance in lifting tables, of the type of which includes at least one first lifting arm (3) and one second lifting arm (4) being articulatedly interconnected by means of a first joint (10). The lifting mechanism also includes a force applying means (5) acting on one of the lifting arms, the force applying means (5) and the lifting arms (3, 4) in the initial position, before the initiation of the lifting movement, being oriented generally parallel with respect to each other in a common plane in order to achieve a low constructional height of the lifting mechanism. The force from the force applying means (5) is transmitted to the first lifting arm (3) via a double-armed lever (13) connected to the first lifting arm (3) by means of a second joint (17), the force applying means (5) acting on one part (19) of the lever (13) via a third joint (11) in such a way that the force from the force applying means (5) is transmitted eccentrically relative to the second joint (17), the second part (20) of the lever (13) acting against a lever support (15) provided on said second lifting arm (4), preferably between said first joint (10) and said second joint (17). A first abutment (21) on the lever (13) engages the second abutment (14) provided on that first lifting arm (3) after a limited movement of the lever (13) corresponding to the initiation of the lifting movement. By this means the lever (13) is blocked against movement relative to the first lifting arm and is disengaged from the second lifting arm (4) during the continued lifting movement, which results in that the force from the force applying means (5) entirely is transmitted to the first lifting arm (3).

6 Claims, 3 Drawing Sheets

Fig. 1
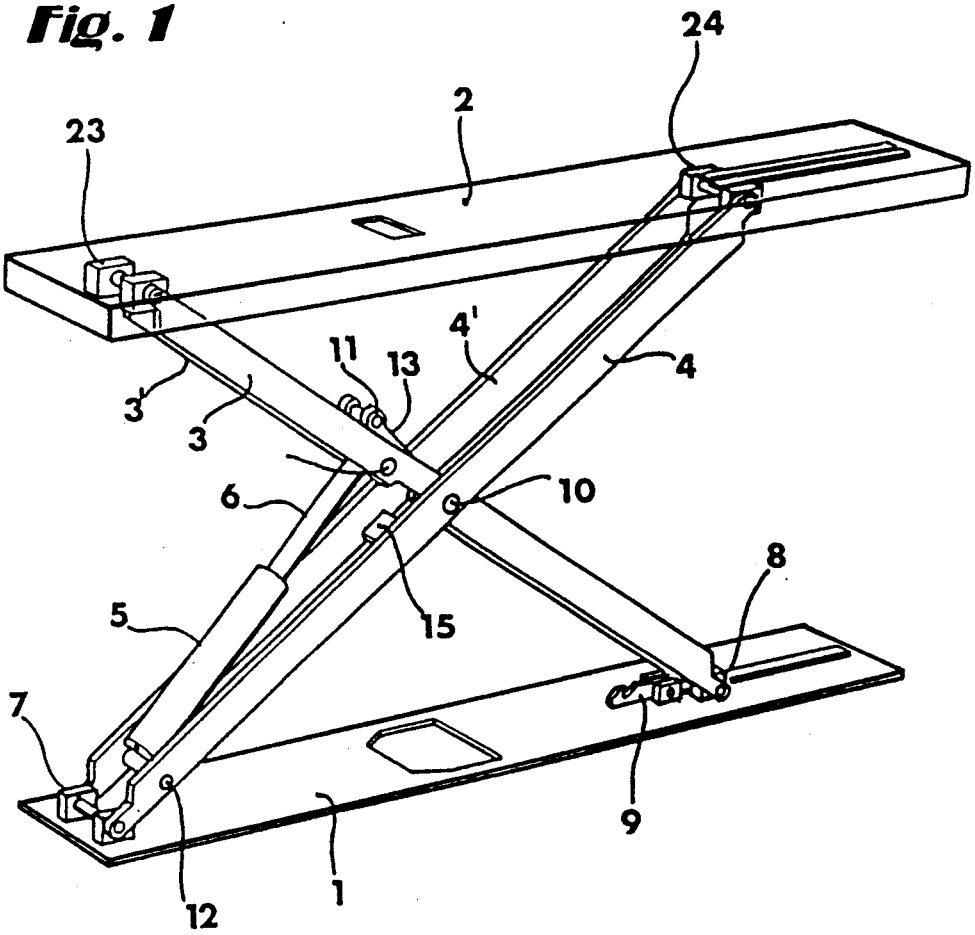
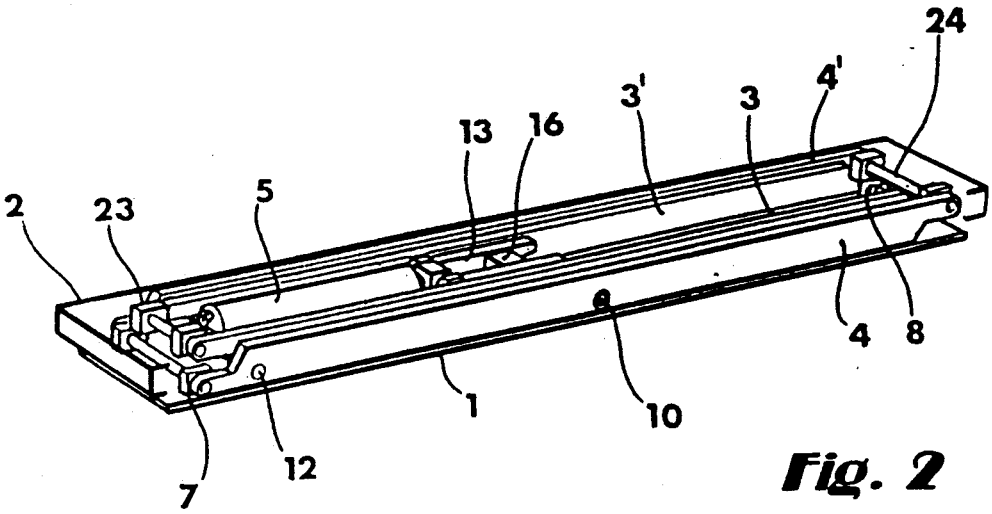
Fig. 2

DEVICE FOR INITIATING A LIFTING MOVEMENT IN A LIFTING DEVICE

TECHNICAL FIELD OF THE INVENTION

The invention relates to a device for initiating a lifting movement in a lifting mechanism, for instance in lifting tables, including a least a first lifting arm and a lifting second arm, articulatedly interconnected by means of a first joint, the lifting mechanism also including a force applying means acting on one of the lifting arms, the force applying means and the lifting arms being oriented generally parallel with respect to each other in the initial position, before the initiation of the lifting movement.

BACKGROUND OF THE INVENTION

Devices of the kind mentioned above are to a great extent used for instance in lifting tables, which in the initial position, before initiation of the lifting movement, should have a very low height, i.e. wherein lifting arms and the force applying means included in the lifting table preferably should be oriented generally parallel to each other on the ground. In order that it may be possible to initiate a lifting movement in this case, it is necessary that the connection of the force applying means to the lifting arms is designed especially with regard to this. Examples thereof are the devices disclosed in the Swedish specifications 8304655-7, 8501852-1 and 8602983-2, the U.S. Pat. Nos. 2,862,689 and 2,937,852 as well as German patent specification 17 56 270. In all these devices the lifting movement is initiated by the means that the end of the power applying means forces apart obliquely oriented glide surfaces arranged on each lifting arm, for instance by means of a roller arranged at the end of the force applying means. The force applying means here generally comprise hydraulic cylinders. These previously known constructions function in an excellent way, but, since the glide surfaces are subjected to comparatively large forces from the force applying means when the lifting movement is initiated, these glide surfaces may be subjected to wear and/or deformation, which may have detrimental effect on their function. The construction with rollers and slide surfaces is comparatively expensive and complicated. In addition to this, comparatively high hydraulic pressures generally are necessary due to the specific geometry which is a result of the resulting, comparatively short, effective length of the arms of leverage, which results in that high demands have to be made on the hydraulic equipment.

U.S. Pat. No. 3,991,857 furthermore discloses a lifting device of the kind mentioned in the introduction, in which a roller indirectly is guided and forced in between two surfaces obliquely oriented relative to each other (one oblique surface being arranged on one of the lifting arms and one being the base plate) by means of a complicated system of control plates and abutments guiding the movements of the roller. This device in principle functions in a similar way as the devices described above and suffers generally from the same disadvantage.

U.S. Pat. No. 2,899,172 finally discloses a lifting device of the kind mentioned in the introduction which is constructed and intended for trucks. In this device the lifting movement is initiated by means of a lever acting against the truck frame. This construction thus is limited to a use in connection with stable frames of the kind used in truck frames.

SHORT DESCRIPTION OF THE INVENTIVE CONCEPT

The present invention intends to provide a device for initiating a lifting movement in a lifting mechanism as described above, which is simple in function, construction and operation and in which the force applying means can be dimensioned for comparatively small forces, i.e. that hydraulic devices, if such are used, only are subjected to comparatively low pressures. This is to be achieved while maintaining an extremely low constructional height in the initial position before the initiation of the lifting movement. This is achieved in that the force from the force applying means is transmitted to the first lifting arm by means of a double-armed lever which is connected to the first lifting arm by means of a second articulated joint, the force applying means acting on a first one of the parts of the lever via a third articulated joint in such a way that the force from the force applying means is transmitted eccentrically relative to the second articulated joint, the second arm of the lever acting against a lever support provided on the second lifting arm, preferably between the first articulated joint and second articulated joint, a first abutment on the lever engaging a second abutment provided on the first lifting arm after a limited movement of the lever corresponding to the initiation of the lifting movement, by which means the lever is blocked against further movement relative to the first lifting arm and is disengaged from the second lifting arm during the continued lifting movement, which results in that the force from the force applying means is transmitted entirely to the first lifting arm.

Advantageous embodiments and developments of the invention can be in found the attached dependent claims.

SHORT DESCRIPTION OF THE ATTACHED DRAWINGS

FIG. 1 shows a lifting table incorporating the invention in a perspective view and in a raised position.

FIG. 2 shows the lifting table in FIG. 1 in a lowered position.

DETAILED DESCRIPTION OF A PREFERRED EMBODIMENT OF THE INVENTION

Figure 3:
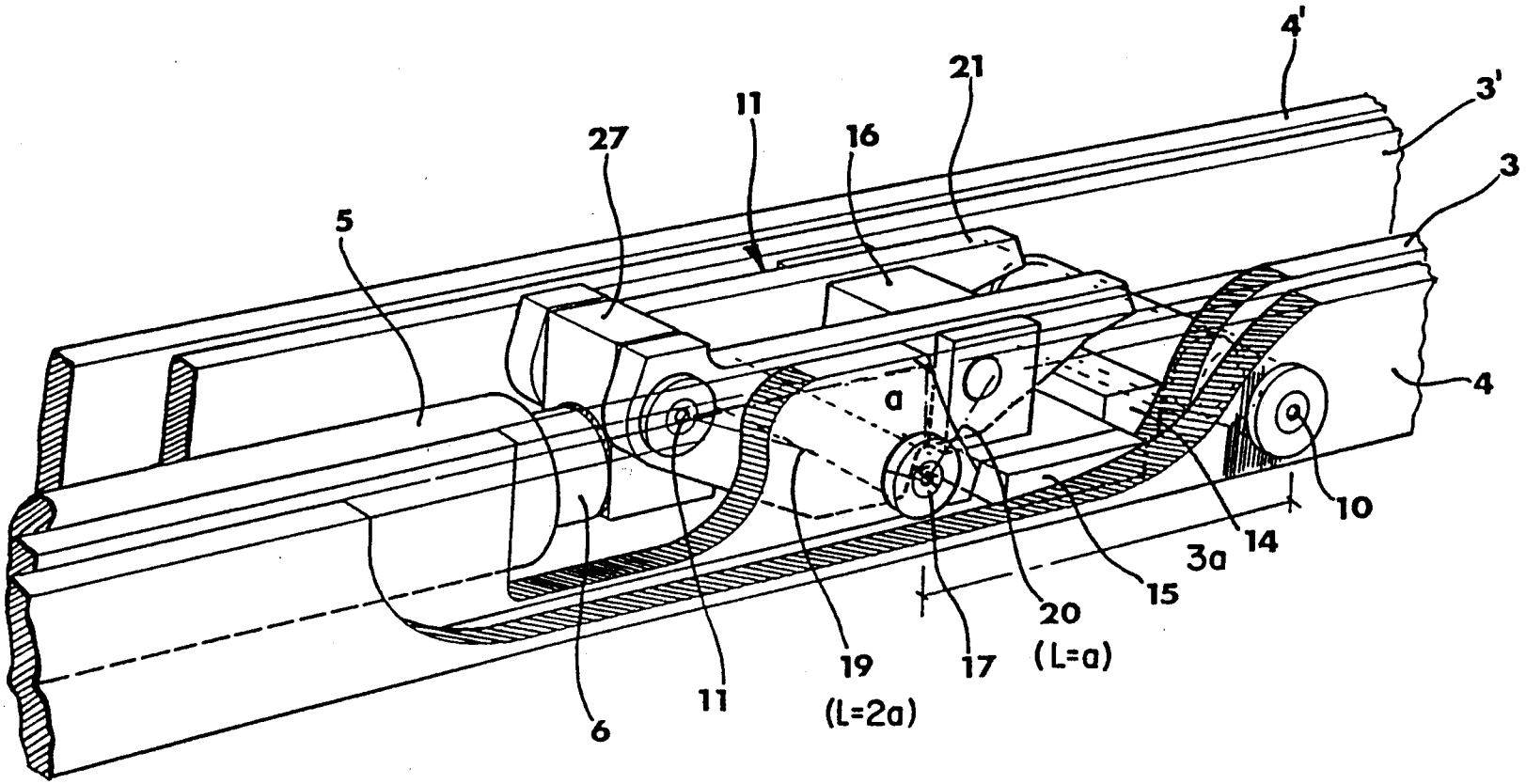
FIG. 3 is an enlarged detail of the lever and its connections to the lifting arms and force applying means in a perspective view.

In FIG. 1 and 2 the invention is shown applied to a lifting table which in a conventional way includes a base part 1, a table 2, a first pair of lifting arms 3, 3' and a second pair of lifting arms, 4, 4' and a force applying means in the form of a hydraulic cylinder 5 with a piston rod 6. The pairs 3, 3', 4, 4' of the lifting arms are interconnected by means of a first articulated joint 10. One end of each first lifting arm 3, 3' is connected to the plate 2 by means of an articulated joint 23 and the other end of the first lifting arm 3 is slideably supported against the base part 1 at 8. One end of each second lifting arm 4, 4' is connected to the base part 1 by means of an articulated joint 7 and its other end is slideably supported against the table plate 2 at 24. The hydraulic cylinder 5 is connected to the second pair of lifting arms 4, 4' adjacent one end thereof by means of an articulated joint 12. A double-armed lever 13 is connected to the first lifting arm 3 by means of a second articulated joint 17. The piston rod 6 is connected to the double-armed lever 13 by means of a third articulated joint 11. The hydraulic cylinder 5 and the lever 13 are arranged between the respective pair of lifting arms 3, 3'; 4, 4'. As can be seen in FIG. 2, the lifting arms 3, 3' respective 4, 4' and the hydraulic cylinder 5 in the initial position are positioned in a common plane and parallel with respect to each other in order that a very low constructional height in this position may be obtained.

FIG. 3 shows a detailed enlargement of the middle part of the table in a lowered position in detail. Two pairs of lifting arms 3, 3' respectively 4, 4' are, as stated above, articulatedly interconnected by means of a joint 10. At some distance from this joint 10 the double-armed lever 13, which in this case is designed with two identical parallel parts, is connected to the first pair of lifting arms 3, 3' by means of the joint 17, which is in the form of a shaft passing through both pairs of lifting arms and the pair of levers. In the figure it further can be seen how the joint 11 between the lever and the piston rod 6 has been positioned excentrically relative to the center line of the piston rod 6 by means of a part 27. The joint 17 also is positioned excentrically relative to the center line of the piston rod, but on the opposite side of the piston rod. The eccentric arrangement of the lever relative to the piston rod 6 results in that the hydraulic cylinder in the lowered position can be disposed in parallel to the two pairs of levers 3, 3' respectively 4, 4', by which means the constructive height in this position can be kept down. The lever support 15, which is attached between the two lifting arms 4, 4', also can be seen. The double-armed lever 13 comprises a first lever part or arm 19 between the joint 11 and the joint 17 and a second lever part or arm 20 between the joint 17 and the joint 18. The second lever part 20 is prolonged with a first abutment 21 which is arranged for engagement with a second abutment 14 arranged between the two lifting arms 3, 3'. On the shaft forming the joint 18 a block 16 of a material with a low friction is arranged, for instance made of self-lubricating polyamid or oil-impregnated bronze, which block in the entirely lowered position of the lifting table engages a planar surface on the lever support 15 with a planar surface. The shaft 18 preferably goes through the center of the block 16. The abutment 21 is not in engagement with the abutment 14 in the entirely lowered position of the lifting table. The reference sign 9 designates a catch for securing the table in its uppermost position.

FIG. 3 also shows the preferred length of the respective levers. If the eccentricity of the joint 17 relative to the force transmitted from the force applying means, in the collapsed condition of the device and before the initiation of the lifting movement, defines an arm of leverage having the length a, the length of the first lever part 19 preferably should be about 2*a*, the length of the second lever part 20 should be about a and the distance between the first joint 10 and the second joint 17 should be about 3*a*. The lengths of course can be varied, for instance in such a way that the length of the first lever part 19 should be between 1.5*a* and 2.5*a* the length of the second lever part 20 should be between 0.7*a* and 1.3*a* and the distance between the first joint 10 and the second joint 17 should be between 2*a* and 4*a*, if the abovementioned arm of leverage has the length a.

Figure 4:
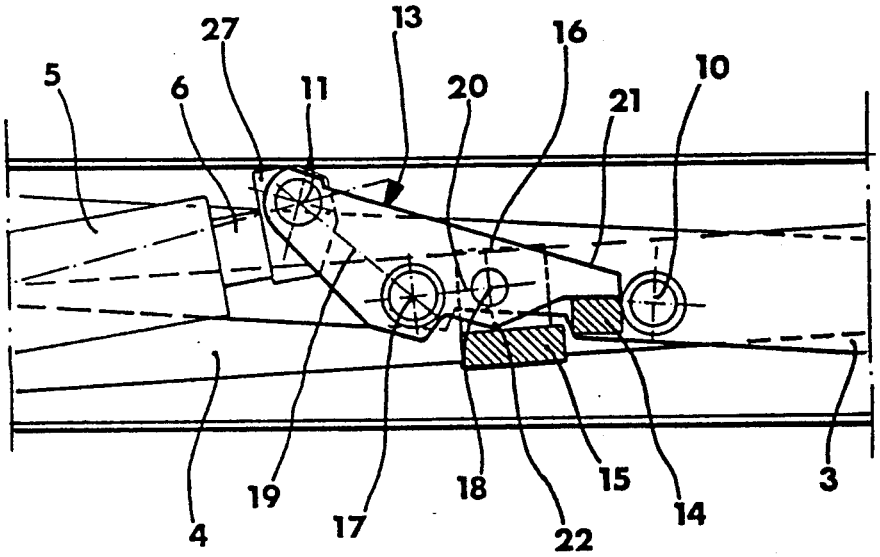
FIG. 4 shows the lever and its connections in a side view in the final stage of the initial part of the lifting movement.
Figure 5:
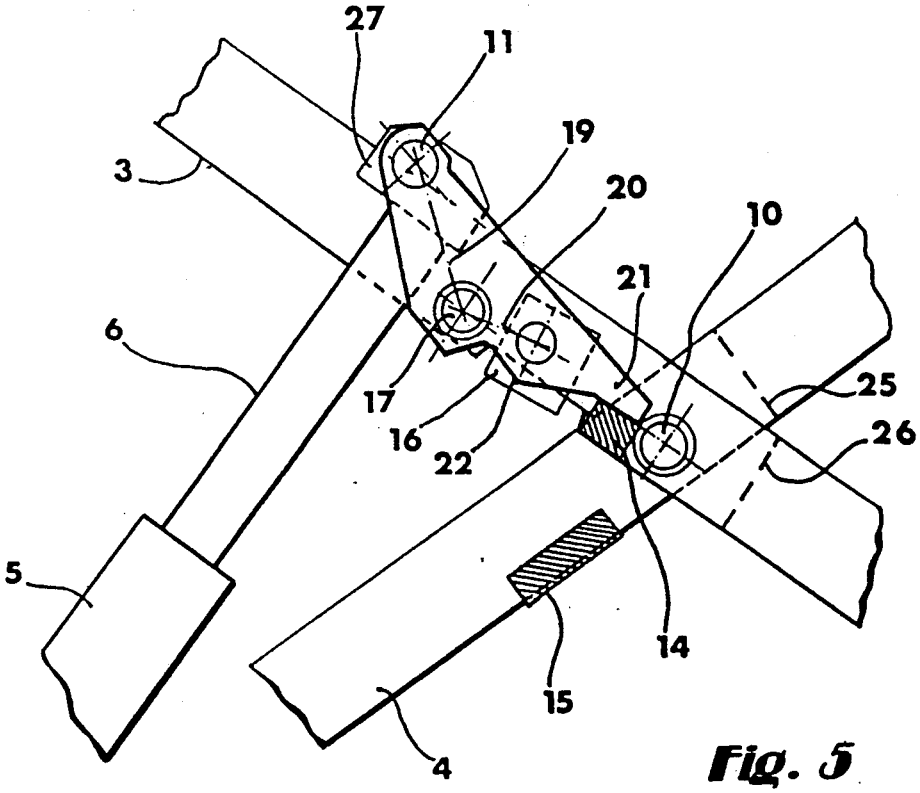
FIG. 5 shows the same parts as in FIG. 4 but in the stage in which the lever has been disengaged from the abutment on the second lifting arm.

The function of the lever and its co-operation with the hydraulic cylinder 5 can be seen more closely in FIGS. 4 and 5. When the lifting table is to be raised, hydraulic fluid under pressure is delivered to the hydraulic cylinder, which will move the piston rod 6 to the right in FIG. 3. Since the lever 13 is connected to the first pair of lifting arms 3, 3' by means of the joint (shaft) 17 and by means of the block 16 engages the lever support 15 fixedly attached to the second pair of lifting arms 4, 4', the lever 13 will force the pairs of lifting arms 3, 3' respectively 4, 4' apart under the influence of the hydraulic cylinder. The block 16 will then glide over the surface of the lever support 15. The effective length of the lever part 19 is considerably greater than the effective length of the lever part 20, which means that a only comparatively small force is necessary to initiate the swinging of the lifting arms away from each other. The effective length of the lever part 19 will increase with the swinging movement of the lever 13.

When the lever 13 has been swung up somewhat under the influence of the hydraulic cylinder 5, the first abutment 21 on the lever 13 will engage the second abutment 14 on the lifting arms 3, 3', which in principle means that the continued lifting movement will be performed as if the piston rod were connected to a fixed point on the lifting arms 3, 3' corresponding to the position of the joint 11, as shown in FIG. 5. The lifting table thereafter will function in the same way as in a conventional lifting table in which the hydraulic cylinder is connected to a fixed point on one of the lifting arms.

With this construction of the lifting mechanism, a very low constructional height in the lowered position is obtained, for instance in lifting tables, concurrently with that a lifting movement will be performed in a certain and a simple way. The parts included in the device for the initiation of the lifting movement are simple and furthermore uncomplicated and will not be subjected to wear. It has proved in practical operation that the block 16 is not subject to any large amount of wear even if it is made of oil-impregnated plastic. However, should this be the case after the long period of use, the block simply can be turned 90°, which will give a new planar surface for co-operation with the lever support 15. It is furthermore very simple to exchange the block which also can be done at a low cost. Due to the fact that the force applying means and the lever have been arranged between the lifting arms, it is possible to design the lifting device with a very narrow construction, if necessary.

CONCEIVABLE MODIFICATIONS OF THE INVENTION

The invention of course can be modified in many ways within the scope of the attached claims. The block 16 for instance can be exchanged for a wheel made of steel or some other suitable material which can roll on the lever support 15 and which is supported on the shaft 18. The lever part 20 furthermore can engage the lever support 15 directly with an engagement surface 22 without the use of a block 16 or similar. In a special case of this embodiment the lever part 20 is provided with a curved surface which engages the lever support 15, the center of curvature and the radius of the curvature for the curved surface being chosen in such a way that the engagement surface of the lever part 20 rolls along the lever support 15 during the initial stages of the lifting movement, which means that the effective length of the lever part 20 will increase to the same degree to which effective length leverage of the force applying means increase when the lifting arms swing upwards under the influence of the force applying means 5.

The abutments 14 and 21 furthermore have been illustrated as being positioned on that side of the joint 17 which is disposed opposite the connection 11 of the hydraulic cylinder 5 to the lever 13. The two abutments of course can be positioned in any other suitable place, for instance on the same side of the joint 17 as the joint 11, possibly also beyond the joint 11.

The device for initiating the lifting movement has been illustrated here as being applied on a lifting table having two crossing lifting arms interconnected in their middle part by means of a joint. The device of course also can be applied to lifting mechanisms including two lifting arms or pairs of lifting arms, which are articulatedly interconnected at their ends, the lever being provided adjacent the joint between the lifting arms in similarity with the arrangement in the lifting table. Such a construction is for instance obtained if the lifting arms 3,4 shown in FIG. 5 are cut along the dotted lines 25 and 26. This construction is especially suitable if a tilting movement of a plate by swinging the plate around an axis arranged perpendicularly to the plane of the drawing in FIG. 5 is desired, for instance along an edge of the plate, instead of a rectilinear lifting movement of the plate.

It is furthermore not necessary to arrange the joint 11 excentrically in relation to the center line of the piston rod 6. If a hydraulic cylinder is used having a cross section which in this context is small, the cylinder instead can be somewhat obliquely oriented. It is only necessary that the force from the cylinder is transmitted excentrically in relation to the joint 17.

I claim:

1. A device for initiating a lifting movement in a lifting mechanism comprising at least a first lifting arm and a second lifting arm interconnected by a first joint, the lifting mechanism also including a force applying means for acting on one of said first and second lifting arms, said force applying means and said first and second lifting arms in an initial position being oriented generally parallel with respect to each other before the initiation of the lifting movement, wherein a force from said force applying means is transmitted to said first lifting arm by a double-armed lever connected to said first lifting arm by a second joint, said force applying means acting on a first lever arm of said double-armed lever via a third joint in such a way that the force from said force applying means is transmitted eccentrically relative to said second joint, a second lever arm of said double-armed lever acting against a lever support provided on said second lifting arm between said first joint and said second joint, a first abutment on said double-armed lever engaging a second abutment provided on said first lifting arm after a limited movement of said double-armed lever, corresponding to the initiation of the lifting movement, such that said double-armed lever is blocked against said first lifting arm and in continued lifting movement is disengaged from said second lifting arm such that the force from said force applying means is transmitted entirely to said first lifting arm.

2. The device according to claim 1, wherein the length of said first lever arm is 1.5 to 2.5 times the length of said second lever arm, and the distance between said first joint and said second joint is about 3 times the length of said second lever arm when the eccentricity of said second joint of said double-armed lever relative to the force transmitted from said force applying means defines an arm of leverage having a length equal to the length of said second lever arm in a fully collapsed condition of the device.

3. The device according to claim 2, wherein the length of said first lever arm is about 2 times the length of said second lever arm.

4. The device according to claim 2, wherein a shaft is arranged on said second lever arm, and a block of a low friction material is arranged on said shaft, said block being provided with a first glide surface co-operating with a second glide surface arranged on the lever support.

5. The device according to claim 4, wherein the block is square or rectangular in cross-section, and wherein a planar side of said block forms said first glide surface; and wherein said second glide surface is also planar.

6. The device according to claim 1, wherein said second lever arm engages said lever support directly with an engaging surface.

* * * * *